United States Patent [19]

Lee

[11] Patent Number: 4,934,343

[45] Date of Patent: Jun. 19, 1990

[54] IN-LINE NOISE ATTENUATION DEVICE

[75] Inventor: Carlos Lee, Chatham, Canada

[73] Assignee: Siemens-Bendix Automotive Electronics Limited, Chatham, Canada

[21] Appl. No.: 439,712

[22] Filed: Nov. 21, 1989

[51] Int. Cl.[5] ..... F02M 35/00

[52] U.S. Cl. ..... 123/52 M; 181/206; 181/229; 60/312

[58] Field of Search ..... 123/52 M, 52 MC, 52 MB, 123/52 MV; 181/206, 229; 60/312, 324, 685

[56] References Cited

U.S. PATENT DOCUMENTS

| | | | |
|---|---|---|---|
| 3,948,349 | 4/1976 | Bychinsky | 181/206 |
| 4,254,746 | 3/1981 | Chiba et al. | 123/52 M |
| 4,359,134 | 11/1982 | Jackson | 181/206 |

FOREIGN PATENT DOCUMENTS

| | | | |
|---|---|---|---|
| 1199514 | 8/1965 | Fed. Rep. of Germany | 181/206 |
| 0148922 | 11/1979 | Japan | 181/229 |
| 137829 | 4/1921 | United Kingdom | 181/206 |
| 2203488 | 10/1988 | United Kingdom | 123/52 M |

*Primary Examiner*—David A. Okonsky

*Attorney, Agent, or Firm*—George L. Boller; Russel C. Wells

[57] ABSTRACT

The device has an entrance and an exit with two low-restriction venturi sections placed in parallel between the entrance and exit. The entering gas flow is separated into two parts, one to pass through one venturi section and the other to pass through the other venturi section. The two parts reunite as they leave the exit. The venturi sections are substantially identical and each contains at least one venturi. The two sections are axially offset from each other by a distance that is equal to one-quarter of the wavelength of the frequency of a principal noise component so that that particular noise frequency is phase shifted 180 degrees by one venturi section relative to the other with resulting cancellation and significant noise attenuation. Usage in an air induction system of an internal combustion engine for attenuating noise from the engine is illustrated. The device is capable of functioning irrespective of the direction of noise in relation to the direction of gas flow.

14 Claims, 1 Drawing Sheet

IN-LINE NOISE ATTENUATION DEVICE

BACKGROUND AND SUMMARY OF THE INVENTION

This invention relates to an in-line noise attenuation device for a gas conduit. The device has the ability to cause significant noise attenuation in a conduit without imposing serious restriction to gas flowing through the conduit. The device also has a bi-directional capability that makes it useful both in a situation where the direction of noise propagation through the conduit is the same as that of the gas flow and in a situation where the direction of noise propagation through the conduit is opposite that of the gas flow.

In an automotive vehicle that is powered by a naturally aspirated internal combustion engine, intake air for the engine is sucked through the air induction system. Depending upon the particular engine configuration and manner in which it is operated, noise can propagate back through the air induction system and escape. Too high a level of such noise can be deemed objectionable, and it may therefore become essential to muffle such noise by means of a noise attenuating device. As much as causing significant noise attenuation, it is an equally essential requirement for such a device that it impose no significant restriction on the induction air flow into the engine.

The present invention relates to a new and unique in-line noise attenuation device that complies with the aforementioned requirements of significant noise attenuation and insignificant gas flow restriction. A further attribute of the invention is that it can be conveniently fabricated and installed. Indeed, the preferred embodiment that will be described herein can be fabricated as a single plastic part by conventional plastic blow molding technology. Because usage of the invention is possible in both applications where the direction of noise propagation through a conduit is the same as the gas flow and in applications where the direction of noise propagation is counter to the gas flow, certain principles of the invention have potentially wider application than simply in the application that is to be specifically illustrated and described herein.

Further features, advantages, and benefits of the invention may suggest themselves to the reader as the description proceeds. The accompanying drawing presents a presently preferred embodiment of the invention in accordance with the best mode contemplated at the present time for the practice of the invention as a noise attenuating device for the air induction system of an automotive internal combustion engine.

DESCRIPTION OF THE PREFERRED EMBODIMENT

Figure 4:
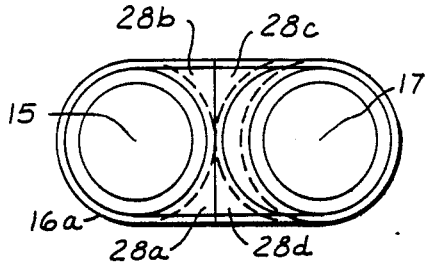
FIG. 4 is an end view taken in the direction of arrows 4—4 in FIG. 2.
Figure 1:
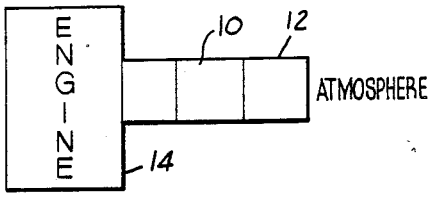
FIG. 1 illustrates, in a schematic fashion, usage of the device in an air induction system.
Figure 2:
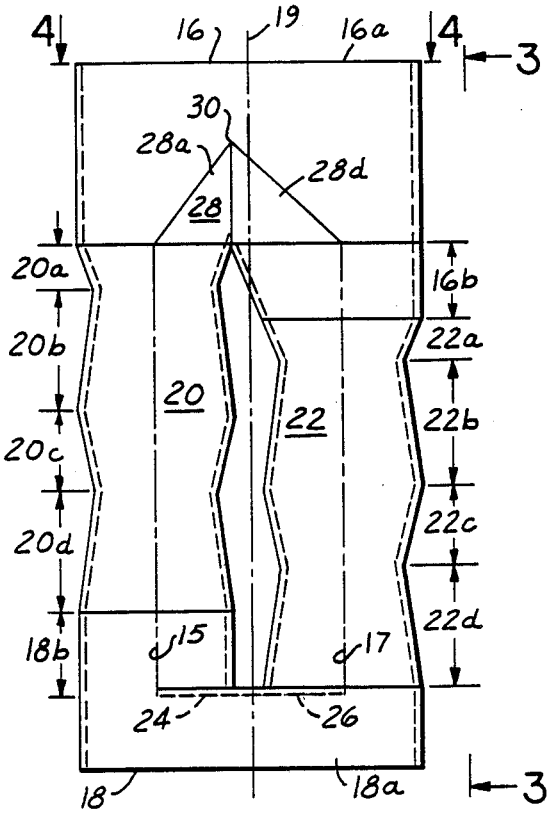
FIG. 2 illustrates a longitudinal plan view of the device.
Figure 3:
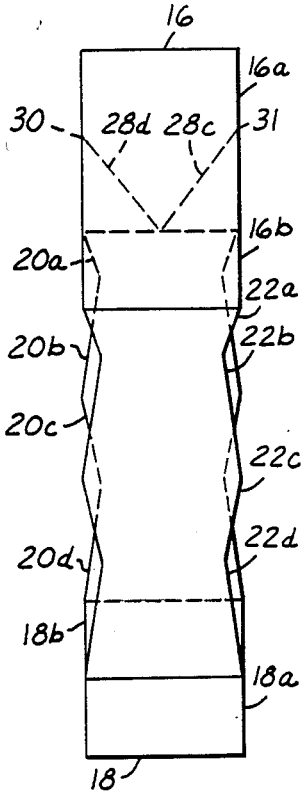
FIG. 3 is a longitudinal view taken in the direction of arrows 3—3 in FIG. 2.

FIG. 1 presents an illustrative usage of an in-line noise attenuation device 10 in the air induction system 12 of an internal combustion engine 14. Device 10 is disposed in-line in induction system 12 so that atmospheric air that is sucked in by engine 14 passes through the device without significant restriction while the device causes significant attenuation of noise that propagates back through the system toward atmosphere. Details of device 10 are presented in FIGS. 2–4.

Device 10 is a single plastic part that contains an entrance end portion 16 that is toward atmosphere and an exit end portion 18 that is toward engine 14. It also contains a first venturi portion 20 and a second venturi portion 22, which are arranged side-by-side in parallel flow relation between end portions 16 and 18. Venturi portion 20 is symmetric about a longitudinal axis 15 while venturi portion 22 is symmetric about a longitudinal axis 17, both said axes being parallel with and equidistant from a main central longitudinal axis 19 of the device.

Each end portion 16, 18 comprises a terminal end portion, **16*a*, 18*a* respectively, having a tubular wall, whose transverse cross section may be considered to be in the shape of a racetrack, i.e. an elongated circle. When device 10 is in use, hoses (not shown) forming at least a portion of the induction air system are fitted over terminal end portions 16*a*, 18*a* in a sealed manner so that induction air is conveyed to entrance end portion 16 and from exit end portion 18 as it passes through induction system 12**.

Beginning at where it merges with entrance end portion 16 and extending to where it merges with exit end portion 18, venturi section 20 comprises, in succession, a converging frustoconically walled section **20*a*, a diverging frustoconically walled section 20*b*, a converging frustoconically walled section 20*c*, and a diverging frustoconically walled section 20*d*. At its maximum diameter, section 20*a* has a radius that is equal to the radius of the semi-circular end of the race-track-shaped terminal end portion 16*a* into which the semi-circular half of section 20*a* that is farthest from axis 19 merges, both radii lying on axis 15**.

There is a transition section **18*b* via which section 20*d* merges with terminal end portion 18*a*. Transition section 18*b* has a uniform circular transverse cross section whose radius is equal to the radius of the semi-circular end of the race-track-shaped terminal end portion 18*a* into which the semi-circular half of section 18*b* that is farthest from axis 19 merges, these respective radii also lying on axis 15. This configuration results in a transverse wall portion 24 bounding the semi-circular portion of section 18*b* that is nearest axis 19**.

Beginning at where it merges with entrance end portion 16 and extending to where it merges with exit end portion 18, venturi section 22 comprises, in succession, a converging frustoconically walled section **22*a*, a diverging frustoconically walled section 22*b*, a converging frustoconically walled section 22*c*, and a diverging frustoconically walled section 22*d*. There is a transition section 16*b* via which section 22*a* merges with terminal end portion 16*a*. Transition section 16*b* is of generally tubular shape; the half that is nearest axis 19 has a frustoconically tapered shape having a cone angle the same as that of section 22*a* and forming a continuation of the half of section 22*a* that is nearest axis 19; the half of section 16*b* that is farthest from axis 19 has a uniform semi-circular cross-sectional shape whose radius is equal to the radius of the semi-circular end of the race-track-shaped terminal end portion 16*a* with which it merges, both radii lying on axis 17**.

At its maximum, the radius of section 22d is equal to the radius of the semi-circular shaped end of terminal end portion 18 into which the half of section 22d that is farthest from axis 19 merges. The result of this configuration is a transverse wall 26 bounding the half of section 22d that is nearest axis 19 at the transition between section 22d and terminal end portion 18a, said wall 26 being contiguous, and merging, with wall 24.

A final structural feature of the device is the presence of a smooth aerodynamically shaped wedge 28 within entrance portion 16. The function of wedge 28 is to separate the flow entering entrance 16 so that it splits into two streams through the respective venturis 20 and 22 without any appreciable entrance turbulence. Wedge 28 may be considered as comprising four wall portions designated 28a, 28b, 28c, and 28d in FIG. 4. Wall portions 28a, 28b form what amounts to an extension of the half of venturi section 20a that is nearer axis 19 while wall portions 28c, 28d do the same for the corresponding portion of transition section 16b. The portions 28a and 28d share a common apex 30 and the portions 28b and 28c share a common apex 31. Each apex is asymmetrical with respect to axis 19 due to the fact that the mutual tangency of the entrance end of section 20a and the entrance end of transition portion 16b are also asymmetrical with respect to axis 19. The surface of each portion 28a, 28b, 28c, 28d is of a general concave shape defined in transverse cross section at any location along axis 19 by an arc that is concave toward the respective axis 15, 17, specifically axis 15 for sections 28a, 28b and axis 17 for sections 28c, 28d.

When device 10 is used in the arrangement of FIG. 1, the direction of noise propagation through the device is from exit end portion 18 to entrance end portion 16, a direction opposite the direction of air flow. As air enters the device at entrance end portion 16, it separates into two more or less equal parts, one to flow through venturi section 20, the other through venturi section 22. The flows emerging from the venturi sections 20, 22 exit the device via exit end portion 18.

Noise from engine 14 entering exit end portion 18 also tends to separate into two more or less equal parts, one to pass through venturi section 20, the other through venturi section 22. The venturi sections change the pressure and particle velocity, thereby changing the impedance or resistance to motion. However, the noise that propagates through venturi section 20 enters section 20 at a certain time interval after the noise that propagates through venturi section 22 enters section 22 because the two venturi sections 20 and 22 are relatively offset from each other in the direction of noise propagation. By making the two venturi sections 20 and 22 essentially identical, the effect of the relative axial offset of one to the other is to create a certain phase shift in each frequency component of the noise passing through one venturi section relative to a corresponding noise frequency component passing through the other venturi section by the time the noise emerges from entrance end portion 16. If it is assumed that the noise consists of a principal frequency component that is desired to be attenuated, then by making the relative axial offset between the two venturi sections 20, 22 equal to one-fourth of the wavelength of the principal frequency component, the device will have imposed on that principal frequency component a 180 degree relative phase shift between the noise that has propagated through venturi section 22 and that which has propagated through venturi section 20 by the time that the noise exits entrance end portion 16. The net effect of this phase shift on the principal frequency component exiting the device is that the principal frequency component that has passed through one venturi section tends to cancel the principal frequency component that has passed through the other venturi section whereby the principal frequency component is significantly attenuated as it exits the device.

In designing a specific embodiment of the device, it will be typical for the device to be designed for attenuation of a particular frequency of noise, and this is where the maximum attenuation will occur. Because noise often consists of a range of frequencies and/or harmonics, the device can also have a beneficial effect on noise frequencies other than the principal one. In other words, the device can be considered to possess certain bandwidth for noise attenuation.

For best results, the two relatively offset venturi sections should be identical. It is not essential however that a device that has more than one venturi in a venturi section have those venturis identical even though the device which has been illustrated and described herein comprises two identical venturis in each venturi section. Likewise, a device embodying principles of the invention can be used not only where the noise propagates counter to the gas flow, but also where the noise propagates in the same direction as the gas flow.

Although the illustrated device is also advantageous because it can be fabricated as a single plastic part, principles of the invention can be practiced in devices composed of multiple parts. Therefore, while a presently preferred embodiment of the invention has been illustrated and described, principles can be practiced in other equivalent embodiments.

What is claimed is:

1. An in-line noise attenuation device for insertion into a gas-carrying conduit to significantly attenuate noise propagating through the conduit without imposing significant restriction on the gas flow, said device comprising inlet and outlet ends via which gas respectively enters and exits the device, noise entering one of said ends and exiting the other of said ends, said device further comprising two venturi sections arranged as parallel flow paths between said inlet and outlet ends, the noise passing through said two venturi sections between said one end and said other end, each of said venturi sections comprising at least one venturi, and wherein one venturi section is offset from the other in the direction of noise propagation to create at said other end a relative phase shift between the noise that has passed through one venturi section and the noise that has passed through the other venturi section such that at least some of the noise that has passed through said one venturi section cancels at least some of the noise that has passed through said other venturi section whereby the noise that exits said other end of the device is significantly attenuated from that which would otherwise exist in the absence of the device.

2. A device as set forth in claim 1 wherein said venturi sections are relatively axially offset one-fourth of the wavelength of a principal frequency component of the noise.

3. A device as set forth in claim 2 wherein said venturi sections are substantially identical.

4. A device as set forth in claim 1 wherein said venturi sections are substantially identical.

5. A device as set forth in claim 1 wherein said entrance and exit ends are substantially identical elongated circles lying on a common central axis and wherein each venturi section has its own axis, and the axes of said venturi sections are substantially parallel with and equidistant from said central axis.

6. A device as set forth in claim 5 including an aerodynamic wedge disposed within said inlet end for promoting the smooth separation of incoming gas flow to enter each venturi section without creating significant entrance turbulence.

7. A device as set forth in claim 6 wherein said aerodynamic wedge comprises apices that are eccentric to said control axis and concave wall portions extending from said apices to said venturi sections.

8. A device as set forth in claim 1 wherein said inlet and outlet ends and said venturi sections are a single blow-molded plastic part.

9. A device as set forth in claim 8 including an aerodynamic wedge disposed within said inlet end for promoting the smooth separation of incoming gas flow to enter each venturi section without creating significant entrance turbulence, said aerodynamic wedge being integral with said single blow-molded plastic part.

10. Means for significantly attenuating noise propagating through a gas-carrying conduit without imposing significant restriction on the gas flow comprising means for separating the gas flow into multiple parallel flow paths and then reuniting the separated flows wherein said flow paths contain substantially identical venturi sections that are arranged in an axially offset relation to each other to create relative phase shift between the noise that has passed through each flow path such that at least some noise cancellation occurs in the noise that has passed through said parallel flow paths whereby the noise is significantly attenuated from that which would otherwise exist in the absence of said means.

11. Means as set forth in claim 10 wherein there are two flow paths whose relative axial offset is substantially one-fourth of the wavelength of a principal frequency component of the noise.

12. Means as set forth in claim 11 wherein said parallel flow paths are embodied in a single part that contains a common entrance to and a common exit from said flow paths.

13. Method for significantly attenuating noise propagating through a gas-carrying conduit without imposing significant restriction on the gas flow comprising separating the gas flow into multiple parallel flows that pass through substantially identical venturi sections that are arranged in an axially offset relation to each other and then reuniting the separated flows to create in the reunited flows relative phase shift between the noise that has passed through each flow path such that at least some noise cancellation occurs in the noise that has passed through said venturi sections whereby the noise is significantly attenuated from that which would otherwise exist without separating the flow, passing the separated flows through said venturi sections, and then reuniting the flows.

14. Method as set forth in claim 13 wherein the flow is separated into two parts that are passed through respective venturi sections that are relatively axially offset substantially one-fourth of the wavelength of a principal frequency component of the noise.

* * * * *